US006386138B1

(12) United States Patent
Schramm

(10) Patent No.: US 6,386,138 B1
(45) Date of Patent: May 14, 2002

(54) SPILL-PROOF COLORING CONTAINER

(76) Inventor: Michael R. Schramm, 350 W. 2000 South, Perry, UT (US) 84302

( * ) Notice: Subject to any disclaimer, the term of this patent is extended or adjusted under 35 U.S.C. 154(b) by 0 days.

(21) Appl. No.: 09/287,798

(22) Filed: Apr. 7, 1999

Related U.S. Application Data

(63) Continuation-in-part of application No. 09/021,617, filed on Feb. 10, 1998, now Pat. No. 5,908,057, which is a continuation of application No. 08/608,854, filed on Feb. 29, 1996, now Pat. No. 5,832,969, which is a continuation-in-part of application No. 08/086,541, filed on Jul. 1, 1993, now Pat. No. 5,495,876, which is a continuation-in-part of application No. 07/828,345, filed on Jan. 30, 1992, now Pat. No. 5,246,046.

(51) Int. Cl.[7] ..... B05C 3/02

(52) U.S. Cl. ..... 118/26; 118/13; 118/500; 206/1.8; 220/731; 220/734; 220/736

(58) Field of Search ..... 206/1.8; 220/4.01, 220/4.12, 4.13, 4.16, 4.28, 729, 731, 734, 736; 118/13, 26, 500; 426/250

(56) References Cited

U.S. PATENT DOCUMENTS

| | | | | | |
|---|---|---|---|---|---|
| 1,254,714 | A | * | 1/1918 | McCombs | 220/731 |
| 4,419,103 | A | * | 12/1983 | Balkan | 118/18 |
| 4,573,586 | A | | 3/1986 | Helmer | 211/14 |
| 4,693,205 | A | * | 9/1987 | Thill | 118/13 |
| 4,967,687 | A | * | 11/1990 | McShane | 118/13 |
| 5,074,239 | A | * | 12/1991 | Law | 118/429 |
| 5,678,684 | A | * | 10/1997 | Wright | 206/204 |
| 5,787,838 | A | * | 8/1998 | Abrams | 118/13 |
| 5,895,679 | A | | 4/1999 | Pender et al. | 426/302 |
| 6,168,021 | B1 | | 1/2001 | Herbruck | 206/541 |

OTHER PUBLICATIONS

Sun Hill Industries, Easter Egg Dye and Dry Bunny Tray, 1993, One page copy of product.

Easter Unlimited, All–In–One Egg Coloring Kit, Unknown, Two page copy of product.

* cited by examiner

*Primary Examiner*—Laura Edwards

(57) ABSTRACT

The spill-proof coloring container is an invention that because of its unique geometry and design, will when oriented in any position prevent spillage of liquid contents when filled to predetermined amount. Because of the use of vacuum formed sheet in the construction of the container, the container pieces are compactly stackable and are of substantially low manufacturing cost. The container is principally intended for use by young children to facilitate painting pictures and dying objects such as Easter eggs without the mess otherwise associated with painting and dying.

29 Claims, 4 Drawing Sheets

SPILL-PROOF COLORING CONTAINER

This application is a continuation in part of application Ser. No. 09/021,617 filed Feb. 10, 1998, now U.S. Pat. No. 5,908,057, which was a continuation of application Ser. No. 08/608,854 filed Feb. 29, 1996 and since issued Nov. 10, 1998 as U.S. Pat. No. 5,832,969, which was a continuation-in-part of application Ser. No 08/086,541 filed Jul. 1, 1993 and since issued Mar. 5, 1996 as U.S. Pat. No. 5,495,876, which was a continuation-in-part of application Ser. No. 07/828,345 filed Jan. 30, 1992 and since issued Sep. 21, 1993 as U.S. Pat. No. 5,246,046. The benefit of the filing date of this earlier filed application is claimed under 35 U.S.C. §120.

BACKGROUND OF THE INVENTION

The present invention relates to spill-resistant coloring containers. The invention has particular application for use by children in coloring and more especially by children coloring chicken eggs of the type associated with Easter celebrations.

It is well known that coloring containers have existed for some time and are commercially available in a variety of embodiments. It is noted that when using coloring containers, the user typically requires a plurality of containers to access a plurality of individual paint colors. Also when dying Easter eggs, the user typically requires a plurality of containers to access a plurality of individual dye colors. Prior to applicant's co-pending application, and other applications by applicant which have matured into U.S. patents, these containers have been of a type and geometry which provided little or no resistance to spillage of liquid contents of the container. Furthermore, most of these containers were not easily stackable for compact packaging and typically were not of sufficiently low cost of manufacture to consider the container disposable. It is noted that disposable drink containers such as waxed paper cups with thermoformed plastic lids have existed for some time and are widely available. While such lids typically have an opening to accept a drinking straw, and such opening usually includes a short flange, these flanges are typically not know to extend from the opening of the lid by more than 0.25 inches and thus provide virtually no spill resistance.

SUMMARY OF THE INVENTION

The present invention relates to an improved spill-resistant coloring container. The container can be used in combination with a liquid coloring dye, a chicken egg, and a utensil such as a wire egg dipper, a spoon, a brush, a pair of tongs, or a straw. In practice, the user places a coloring agent such as a liquid dye and a colorable object such as an egg within the container. The user may then use a select utensil to agitate the object and the coloring agent within the container or the user may simply allow the object to dwell unagitated for a period of time within the coloring agent. After a desired amount of time has passed, the user, preferably with the aid of a utensil, withdraws the object from the container. Alternatively, the container can be used with merely a liquid paint and a utensil such as a paintbrush. In practice, the user places the liquid paint within the container. The user then uses the paintbrush to withdraw desired amounts of paint from the container to paint a work piece. Furthermore, the container may be used as a container for edible liquids wherein the users withdraws the edible liquids with a select utensil such as a spoon or a straw.

In a preferred embodiment of the present invention, the container comprises a cup portion and a lid portion. The cup portion and the lid portion each include an engagement ridge such that the lid portion is removably and snappingly attachable to the cup portion. The assembly of the lid and cup together define the spill-proof coloring container. The lid further defines an opening connected to a funnel. The funnel extends into the container and provides communication between the inside of the container and the outside of the container. The funnel facilitates the access of both liquid contents of the container with a utensil as well as the ready insertion and withdrawal of a work piece to be colored such as an egg. The cup includes a well portion which provides for pooling of the liquid contents of the container and provides improved efficiency of the container with a minimal amount of liquid contents. In usage, when a predetermined amount of liquid is placed within the assembled container, the assembled container can be oriented in any position without spilling it's liquid contents.

Both the lid and the cup are comprised of vacuum formed, substantially uniformly thick plastic sheet. The sheet is preferably of a thickness of no greater than 0.05 inches such as 0.05, 0.045, 0.04, 0.035, 0.03, 0.025, 0.02, 0.015, or 0.01 inches thick, and is clear or transparent. The funnel is of a length of preferably at least 0.25 inches and can include any of the following lengths and inches: 0.25, 0.30, 0.35, 0.40, 0.45, 0.50, 0.60, 0.75, 1.0, 1.25, 1.50, 1.75, 2.0, 2.25, 2.75, 3.0, 3.25, 3.50, 3.75, 4.0, and 5.0. Both the lid and the cup are shaped such that multiple lids can be nested or stacked within one another and multiple cups can be nested or stacked within one another.

Accordingly, in the preferred embodiment, it is an object of the present invention to provide a spill-resistant container wherein the members making up the container are stackable to provide for compact packaging of a plurality of container cups and lids within a single package. It is a further object to provide a spill-resistant container wherein the funnel of the container allows for ready ingress and egress of a work piece to be colored such as an egg. It is a further object to provide a spill-resistant container wherein the manufacturing cost of the container is sufficiently low such that the container can be considered disposable. It is a further object to provide a spill-resistant container wherein the members which make up the container define vacuum formed plastic sheet.

DESCRIPTION OF DRAWINGS

The objects and many attendant advantages of this invention will be readily appreciated and become readily apparent as the same becomes better understood by reference to the following detailed description, when considered in conjunction with the accompanying drawings and in which like reference numerals designate like parts throughout the figures thereof and wherein.

DETAILED DESCRIPTION OF THE PREFERRED EMBODIMENT

In order to facilitate the understanding of the present invention in reviewing the drawings accompanying the specification, a feature list is provided below. It is noted that like features are like numbered throughout all of the figures.

FEATURE TABLE

| Number | Feature | Number | Feature |
|---|---|---|---|
| 1 | Container assembly | 34 | Lid funnel |
| 20 | Cup | 36 | Funnel upper opening |
| 22 | Cup engagement ridge | 38 | Funnel lower opening |
| 24 | Cup well | 40 | Liquid coloring agent |
| 30 | Lid | 50 | Egg |
| 32 | Lid engagement ridge | 60 | Brush |

Figure 1:
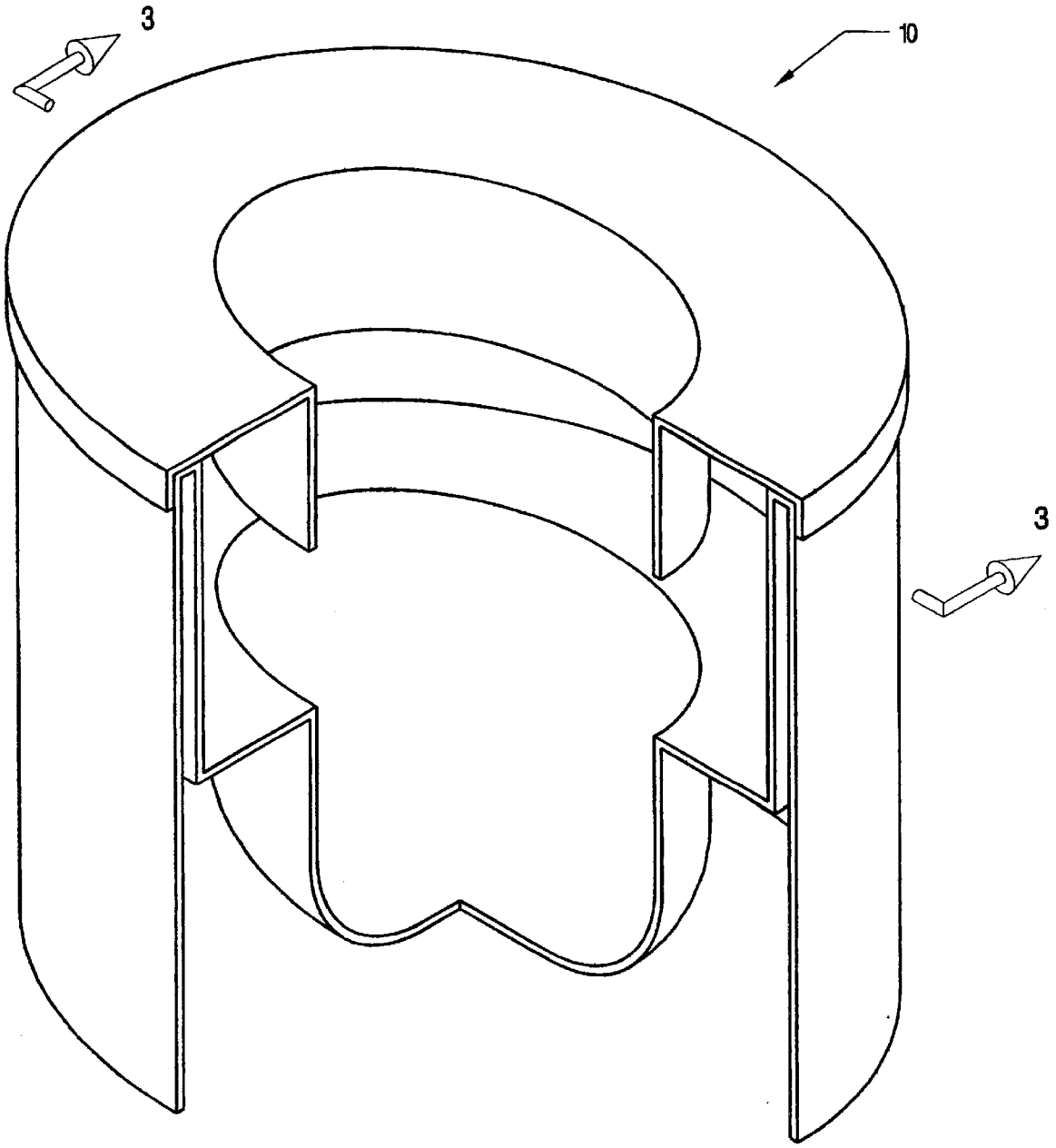
FIG. 1 is an isometric assembly view of the container. The front right portion of the container is shown cut away. Due to the thickness of the container walls being substantially thin and for clarity, cross-hatching is not shown.
Figure 2:
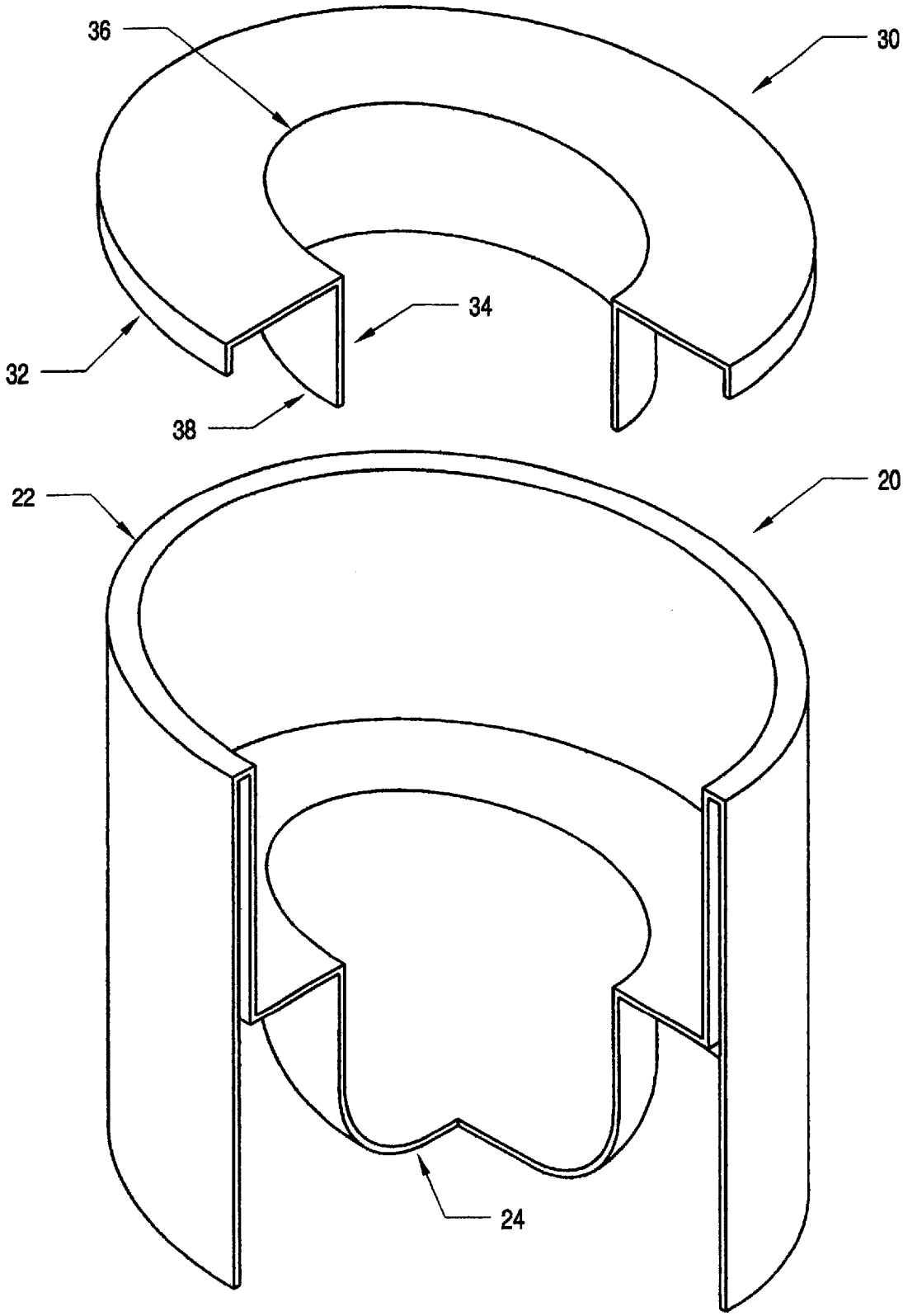
FIG. 2 is an exploded isometric view of the various parts that make up container and illustrates their relationship to each other. The portions shown cut away, are identical to that shown in FIG. 1. Due to the thickness of the container walls being substantially thin and for clarity, cross-hatching is not shown.
Figure 3:
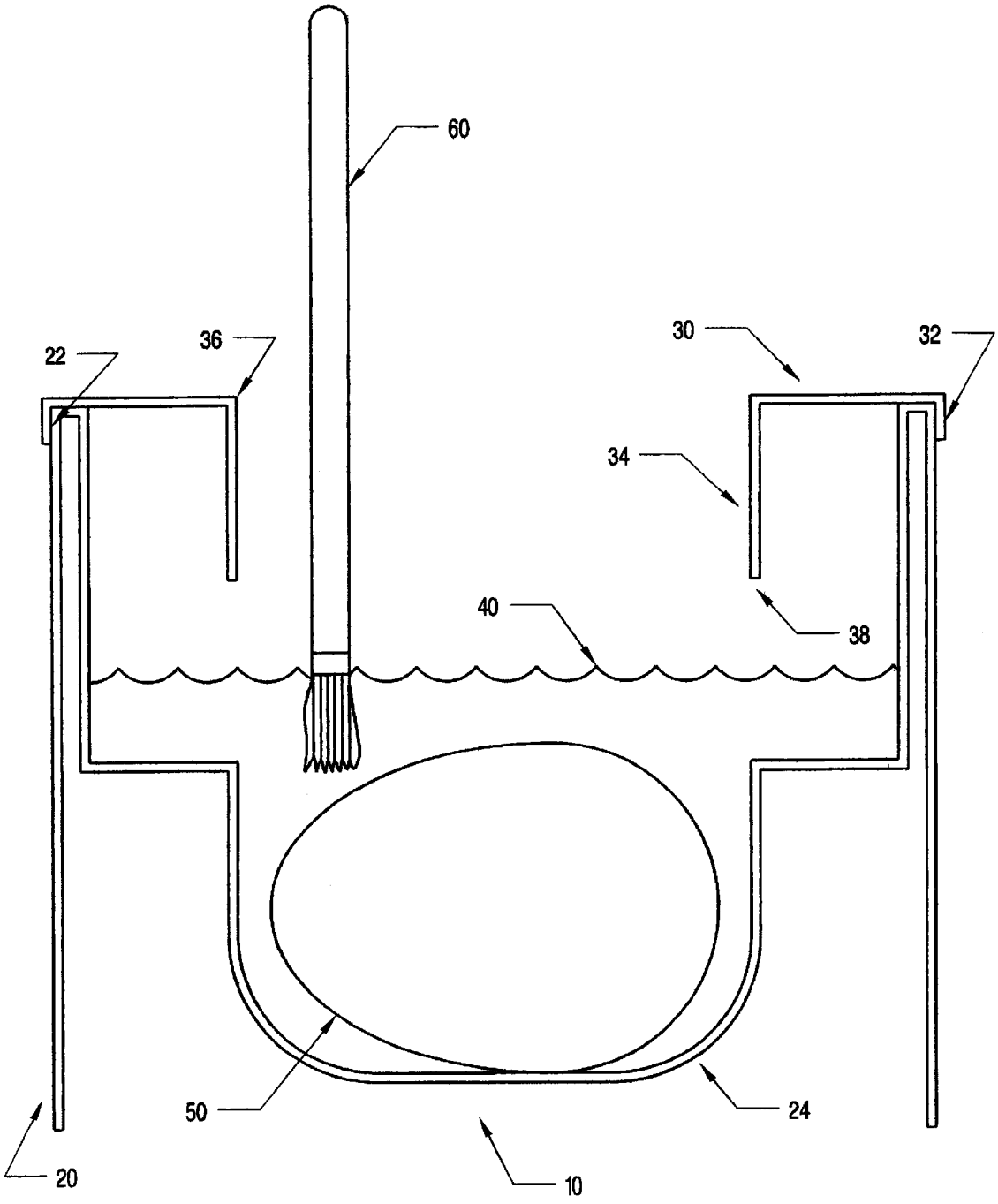
FIG. 3 is an orthographic section view of the container taken at the arrows shown in FIG. 1. Due to the thickness of the container walls being substantially thin and for clarity, cross-hatching is not shown. An egg and liquid dye are shown retained in the bottom of the cup well and a brush is shown removably positioned within the container.
Figure 5:
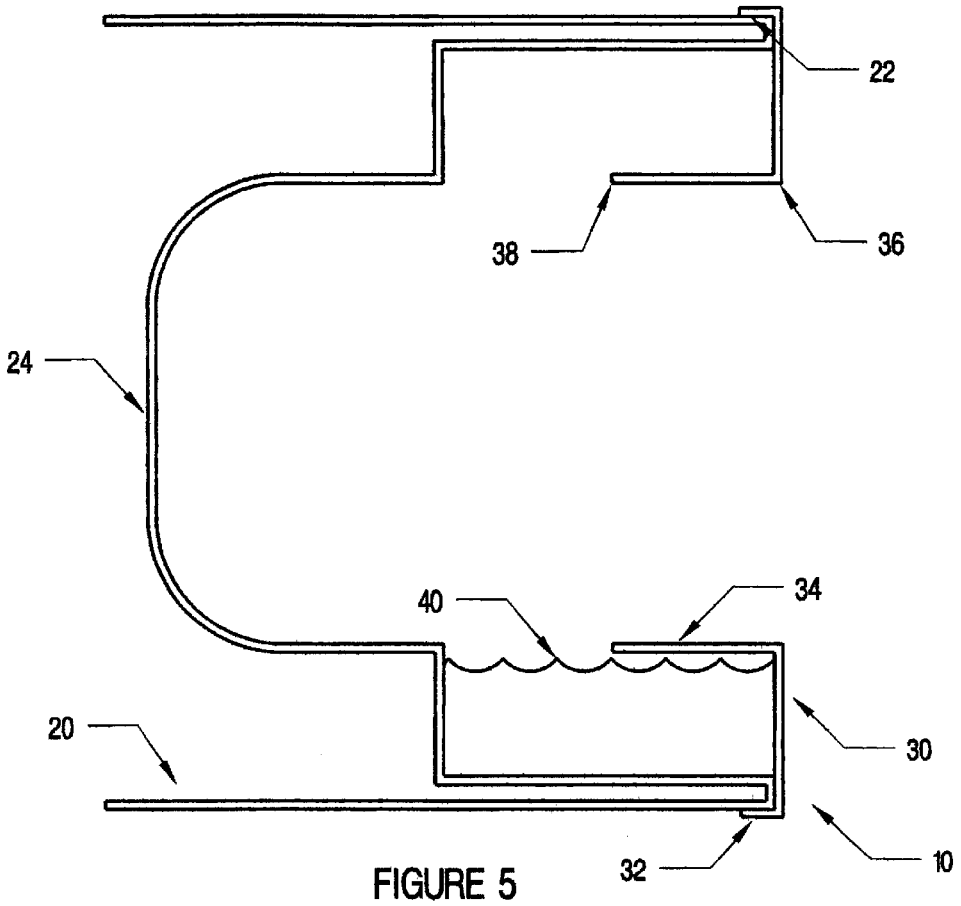
FIG. 5 is a sideways orientation of FIG. 3. Due to the thickness of the container walls being substantially thin and for clarity, cross-hatching is not shown. The liquid dye is shown retained in the side of the container. The egg and the brush are not shown in the container.
Figure 4:
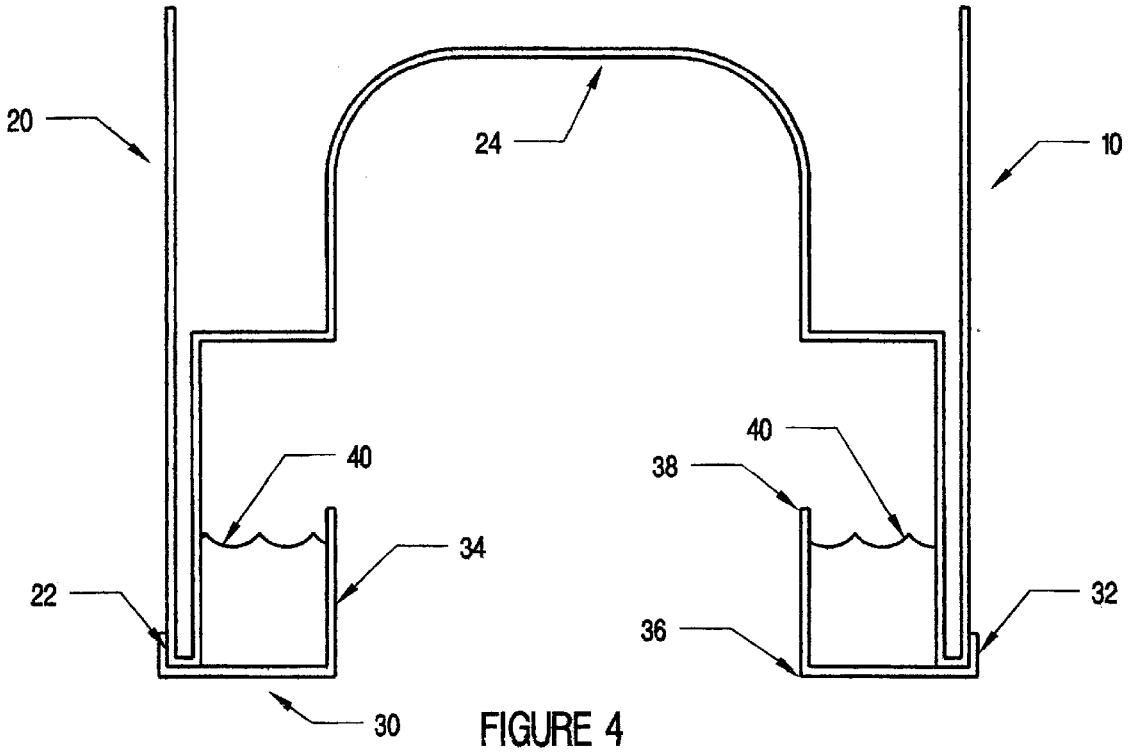
FIG. 4 is an inverted orientation of FIG. 3. Due to the thickness of the container walls being substantially thin and for clarity, cross-hatching is not shown. The liquid dye is shown retained in the top of the container. The egg and the brush are not shown in the container.

Referring now to the drawings and particularly to FIGS. 1 and 2, the invention is a container 10 that comprises a cup 20 and a lid 30. The cup 20 includes an engagement ridge 22, a well 24, and a base flange 26. The lid 30 includes an engagement ridge 32, a funnel 34, a funnel upper opening 36, and a funnel lower opening 38. When cup 20 and lid 30 are snappingly engaged, they form a substantially liquid tight seal. FIGS. 3–5 illustrate the unique advantages of spill resistance of the subject invention in spite of a colorable work piece such as egg 50 being removably placed within container 10 when container 10 is filled with fluid to a predetermined amount and oriented in any orientation. As is apparent from FIG. 3, when container 10 is in the upright position liquid will always be in the well 24 portion of cup 20. When container 10 is in the upside down position as in FIG. 4, the liquid will occupy the space immediately around funnel 34 but will not be able to enter funnel 34 for discharge through funnel opening 38. When container 10 is in a sideways position as in FIG. 5, the liquid level will always be between the side of the funnel 34 and the lower side of the cup 20 and lid 30. Furthermore, when the container 10 is oriented in any of an infinite variations of the above described positions, it will behave in a like manner and prevent the spillage of the liquid contents.

Lastly, the preferred method of fabrication is vacuum form molding for high volume low cost production. The preferred material is clear or transparent sheet of PETE plastic of no more than 0.05 inches thick and preferably in the range of 0.010 to 0.015 inches thick.

While there is shown and described herein certain specific structure embodying the invention, it will be manifest to those skilled in the art that various modifications and rearrangements of the parts may be made without departing from the spirit and scope of the underlying inventive concept. The subject invention is not limited to the particular forms herein shown and described except insofar as indicated by the scope of the appended claims.

I claim:

1. An apparatus comprising a container having an inner cavity, a utensil, and at least one colorable work piece, said container having an opening in a wall of said container and a funnel connected to said opening to provide communication between said inner cavity and an exterior of said container, and wherein said opening is of such a size and shape so as to permit a work piece to pass through said opening, and wherein said inner cavity includes a well formed in a lower surface of said cavity, said well being of such a size and shape so as to receive said work piece, and wherein said at least one colorable work piece is removably contained within said container, and wherein said utensil is removably positioned within said opening of said container for accessing contents of said container through said opening.

2. The apparatus of claim 1 wherein said colorable work piece defines an egg.

3. The apparatus of claim 1 wherein said container contains a coloring agent within said container.

4. The apparatus of claim 3 wherein said coloring agent defines a coloring agent of one of the following group of coloring agents consisting of liquid dye and liquid paint.

5. The apparatus of claim 1 wherein said utensil defines a utensil of one of the following group of utensils comprising a brush, a spoon, a wire egg dipper, a pair of tongs, and a straw.

6. The apparatus of claim 1 wherein said container includes walls and wherein said walls of said container are of a substantially uniform thickness and wherein said substantially uniform thickness defines a thickness of no more than 0.05 inches, and wherein said funnel defines a funnel length of at least 0.25 inches.

7. The apparatus of claim 1 wherein said container defines a container comprising a first member and a second member and wherein said first member is sealingly and detachably engageable to said second member.

8. The apparatus of claim 1 wherein said container defines a container consisting of formed plastic sheet.

9. The apparatus of claim 1 wherein said container defines a transparent container.

10. A container comprising an inner cavity and an opening in a wall of said container, said opening having a funnel connected to said opening to provide communication between said inner cavity and an exterior of said container, and wherein said container removably contains at least one article of the following group of articles consisting of a substantially egg shaped article, an edible article and a substantially egg shaped edible article, and wherein said opening is of such a size and shape so as to permit said at least one article to pass through said opening, and wherein said inner cavity includes a well formed in a lower surface of said cavity, said well being of such a size and shape so as to receive said at least one article.

11. The container of claim 10 wherein said article defines a colorable article.

12. The container of claim 10 wherein said container contains a coloring agent within said container.

13. The container of claim 12 wherein said coloring agent defines a coloring agent of one of the following group of coloring agents consisting of liquid dye and liquid paint.

14. The container of claim 10 wherein said apparatus includes an access device removably positioned within said opening of said container for accessing the contents of said container through said opening.

15. The container of claim 14 wherein said access device defines a device of one of the following group of devices consisting of a brush, a spoon, a wire egg dipper, a pair of tongs, and a straw.

16. The container of claim 10 wherein said container includes walls and wherein said walls of said container are of a substantially uniform thickness and wherein said substantially uniform thickness defines a thickness of no more than 0.05 inches, and wherein said funnel defines a funnel length of at least 0.25 inches.

17. The container of claim 10 wherein said container defines a container comprising a first member and a second member and wherein said first member is sealingly and detachably engageable to said second member.

18. The container of claim 10 wherein said container defines a container consisting of formed plastic sheet.

19. The container of claim 10 wherein said container defines a transparent container.

20. A container comprising an inner cavity, an exterior, an opening in a wall of said container to provide communication between said inner cavity and the exterior of said container and a funnel connected to said opening, wherein said container resists the spillage of liquid contents of said container when said container is oriented in any orientation, and wherein said container removably contains at least one article of the following group of articles consisting of a substantially egg shaped article, an edible article and a substantially egg shaped edible article, and wherein said opening is of such a size and shape so as to permit said at least one article to pass through said opening, and wherein said inner cavity includes a well formed in a lower surface of said cavity, said well being of such a size and shape so as to receive said at least one article.

21. The container of claim 20 wherein said article defines a colorable article.

22. The container of claim 20 wherein said container contains a coloring agent within said container.

23. The container of claim 22 wherein said coloring agent defines a coloring agent of one of the following group of coloring agents consisting of liquid dye and liquid paint.

24. The container of claim 20 wherein said apparatus includes an access device removably positioned within said opening of said container for accessing the contents of said container through said opening.

25. The container of claim 24 wherein said access device defines a device of one of the following group of devices consisting of a brush, a spoon, a wire egg dipper, a pair of tongs, and a straw.

26. The container of claim 20 wherein said container includes walls and wherein said walls of said container are of a substantially uniform thickness and wherein said substantially uniform thickness defines a thickness of no more than 0.05 inches, and wherein said funnel defines a funnel length of at least 0.25 inches.

27. The container of claim 20 wherein said container defines a container comprising a first member and a second member and wherein said first member is sealingly and detachably engageable to said second member.

28. The container of claim 20 wherein said container defines a container consisting of formed plastic sheet.

29. The container of claim 20 wherein said container defines a transparent container.

* * * * *